United States Patent [19]

Klein et al.

[11] 4,444,005

[45] Apr. 24, 1984

[54] STOP MOTION FOR SPINNING FRAME

[75] Inventors: Konrad Klein, Ebersbach-Sulpach; Friedrich Dinkelmann, Rechberghausen; Hermann Guttler, Uhingen, all of Fed. Rep. of Germany

[73] Assignee: Zinser Textilmaschinen GmbH, Fed. Rep. of Germany

[21] Appl. No.: 342,022

[22] PCT Filed: Jun. 7, 1981

[86] PCT No.: PCT/EP81/00065

§ 371 Date: Jan. 12, 1982

§ 102(e) Date: Jan. 12, 1982

[87] PCT Pub. No.: WO81/03502

PCT Pub. Date: Dec. 10, 1981

[30] Foreign Application Priority Data

Jun. 9, 1980 [DE] Fed. Rep. of Germany ..... 3021614

[51] Int. Cl.[3] ..... D01H 13/16; D01H 13/18

[52] U.S. Cl. ..... 57/80; 57/81; 57/86; 57/87

[58] Field of Search ..... 57/80, 81, 84, 86, 87

[56] References Cited

U.S. PATENT DOCUMENTS

| | | | |
|---|---|---|---|
| 2,740,591 | 4/1956 | Woods | 242/38 |
| 3,759,026 | 9/1973 | Hope | 57/80 |
| 4,206,588 | 6/1980 | Venot | 57/80 |

FOREIGN PATENT DOCUMENTS

| | | |
|---|---|---|
| 1535034 | 8/1969 | Fed. Rep. of Germany . |
| 956064 | 7/1949 | France . |
| 1187137 | 9/1959 | France . |
| 1267655 | 6/1961 | France . |
| 2351197 | 12/1977 | France . |
| 475748 | 11/1937 | United Kingdom . |
| 877153 | 9/1961 | United Kingdom . |
| 922773 | 4/1963 | United Kingdom . |

*Primary Examiner*—John Petrakes

*Attorney, Agent, or Firm*—Sughrue, Mion, Zinn, Macpeak, and Seas

[57] ABSTRACT

A spinning frame is provided with a fiber break guard having a fiber guide which as a consequence of the breaking of one of the individual fibers is displaced to cause the breaking of the other fiber. For a certain and rapid breaking of the remaining fiber, the displacement of the fiber guide caused by the remaining fiber, or at least the displacement of an associated member causes a pinching of the remaining fiber in a clamping device or the activation of a fiber separation device for cutting through the remaining fiber.

6 Claims, 10 Drawing Figures

STOP MOTION FOR SPINNING FRAME

BACKGROUND OF THE INVENTION

The invention concerns a spinning frame having a fiber break guard and more particularly to a fiber break guard composed of a pair of fiber guides, one of which moves laterally upon breakage of one fiber to cause separation of the other fiber.

Such a spinning frame produces yarn from two fiber bands twisted together. Further, these fiber bands in the area between the drawing system and the union point are designated as single fibers. The point at which the two fibers meet and after which they are twisted together to form yarn is designated as the union point.

The twisting of the yarn can be accomplished by normal means, preferably by means of a spindle which coaxially penetrates a spinning ring upon which a traveller moved by the yarn can rotate. It is also possible, though, to have other devices for producing the rotation and for winding the yarn, for example a rotating spinning pan, a flyer spindle, or the equivalent.

The causation of a break in the resulting fiber is desirable because the movement of the remaining fiber onto the spinning location is normally not interrupted by the breaking of only one of the two individual fibers, which means that the yarn produced after one of the fibers breaks has a correspondingly low strength.

This defective spot easily can cause breakage of the yarn during later processing, and can lead to defective goods.

Each working location on the spinning frame at which yarn is produced is designated as a spinning location.

With respect to a known spinning frame of this type (DE-Gbm No. 79 12 423), every spinning location has a fiber break guard to produce a fiber break reaction; this guard has a fiber guide for the yarn supported on a holder and movable between two positions. In the first position it is held in equilibrium, but it can be brought out of equilibrium by the influence of the yarn moving past it if it is brought beyond its movement limitations—which happens when there is a break in one of the two individual fibers. In such a case it can swing about 180° down in the vertical plane and about 90° in the horizontal plane, re-routing the remaining fiber through the fiber guide, which is sooner or later supposed to produce the fiber break reaction. There can, however, be cases where this guard fails to produce the fiber break reaction because the rotation imparted by the spindle upon the remaining fiber (allows) the fiber to propagate itself through the fiber guide and onto the drawing system.

SUMMARY OF THE INVENTION

It is therefore a task of the invention to create a spinning frame of the type mentioned above, whereby when there is a fiber break a reaction break of the remaining fibers is accomplished quickly and dependably.

The fiber guide of the fiber break guard can either by entirely displaced from its normal operating position in order to produce a break reaction, or in some cases it is especially efficient to design it such that it is not totally displaced in order to cause the break, but rather has several displaceable members which are independent of one another, at least one of which then must be displaced from its normal position to cause the break.

In one embodiment the fiber break guard according to the invention, the clamping device can in many cases be such that the remaining fibers in it are clamped tight, i.e., can no longer move in the direction of the spindle or its equivalent. Thus the fiber break takes place very quickly for the remaining fibers between the clamping device and the drawing system.

It is, however, not absolutely necessary that the remaining fibers are firmly clamped in the clamping device, but rather it can be sufficient, at least in many cases, to design the clamping device such that instead of becoming clamped in it, the remaining fibers are weakly pinched in such a way that even though they can still move through the device, the weak clamping suppresses the twisting of the fiber in the direction of the drawing system. Thus, although the remaining fibers remain tensed in the area between the drawing system and the clamping device, since those fibers are still being drawn off, in this case there is still a very rapid fiber break if there is sufficient distance between the clamping device and the drawing system. This is so because the twisting of the remaining fiber, produced by the spindle or its equivalent, does not pass into the fiber area between the drawing system and the clamping device, or at least does not pass into it sufficiently, resulting in a quick fiber break due to too little twisting.

The clamping device can be arranged so that it is stationary on the fiber break guard or some other component, or it can preferably be cut in only as a consequence of the breaking of one of the two individual fibers, since at least one of its two components is a movable component which is set off by the breaking of one of the two fibers. In such a case the break causes the engagement of the fiber guide or at least one of its movable components into the position which forms a clamp-down. The rapid cutting of the remaining fiber in another embodiment can be accomplished by means of any appropriate separation device. In a preferred design form it consists of a cutting device for cutting through the thread. Another design form which is advantageous in many cases has a hot wire as a cutting device. The wire is switched on by the movement of the fiber guide or one of its components and the hot wire then burns through the remaining fiber.

DETAILED DESCRIPTION OF THE INVENTION

Figure 1:
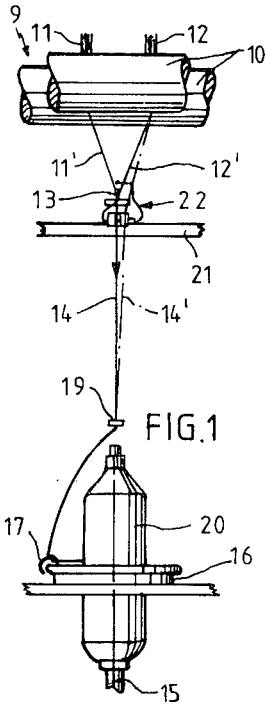
FIG. 1 illustrates a cross-sectional front view of a spinning location of a spinning frame (not illustrated in detail) with a fiber break guard in accordance with a first design example of the invention.

In FIG. 1 the delivery roller pair of a single or multiple drafting zone drawing system (not illustrated in detail here) of a ring spinning frame is designated as 10.

The drawing system draws at the illustrated spinning location 9 two parallel-running fiber bands 11, 12, which can preferably consist of combed wool or if the case may be, other fibers, and which are delivered preferably from a single supply spool (not illustrated), and which after drawing move out of the delivery roller pair 10 while still untwisted. The main drafting zone of the drawing system can have the usual apron leading between the two fiber bands 11, 12. These two fiber bands 11, 12 are guided with considerable clearance from one another by a fiber band guide, not illustrated, and after leaving the delivery roller pair 10 as single fibers 11', 12', they run together at acute angles and meet at the union point 13, where they are twisted together by means of a spindle 15 and traveller 17 rotating about a spin ring 16 in order to form yarn 14. The yarn 14 moves to a fiber guide 19 located above the spindle 15, upon which the so-called fiber balloon begins, which corresponds to the area of yarn which rotates around the spindle 15 and reaches from the fiber guide 19 to the traveller 17. The yarn 14 produced is then wound into a roll 20 on a bobbin placed on the spindle 15.

The union point 13 wanders up and down somewhat during operation, and also somewhat from side to side.

Figure 4:
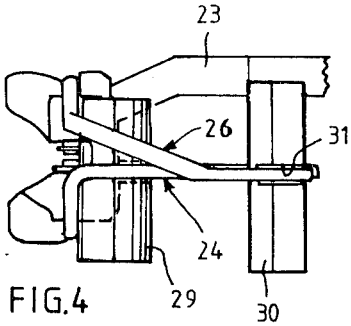
FIG. 4 shows a top view of the fiber break guard as in FIG. 2.

Adjacent the union point 13 a fiber break guard 22 is located on a rail-shaped carrier running horizontally along the given side of the spinning frame. The guard serves several functions and is illustrated in more detail in FIGS. 2 through 4. When both single fibers 11' and 12', and thus the yarn 14 moving to the spindle 15 are available, it serves to limit the lateral deviations of the union point 13 with respect to the direction parallel to the length of the carrier 21. It also serves to generate the thread breaking reaction for the remaining fiber when one of the individual fibers 11' or 12' breaks. This remaining fiber moves from the delivery roller pair 10 to the spindle 15 and is illustrated by way of example in FIG. 1 and designated at 14'. This fiber break guard 22 has a beam 23 attached firmly to the carrier 21 which is stiff and hook-shaped. On this hook-shaped beam is a pivotally-mounted fiber guide 24 made of a bent, stiff wire which pivots parallel to the lengthwise direction of the carrier 21. This fiber guide 24 juts out with its free upper basically straight arm 25 into the normal operational position of FIG. 2 between the two individual fibers 11', 12', and as a consequence of its own weight, which tends to turn it in a clockwise direction in relation to FIG. 2, lies upon the union point 13 of the two individual fibers 11', 12', and is thus pivoted along with the union point 13 during operation. As a result of its location on the union point, this fiber guide 24 serves to guide the yarn 14. In order that the two individual fibers 11' and 12', which have a necessary distance from one another, cannot bind with one another above the arm 25, which under certain circumstances could impair the function of the fiber guide 24, a separation lever 26 is located on the beam 23 of the swing axle, pivotally-mounted on the same axis as the pivot axle of the fiber guide 24. The lever 26 is movable from the position indicated by the dotted lines in FIG. 2 all the way to the fully extended operational position. The movement can be done by hand, and once completed the lever remains in the engaged position 27 due to its own weight. The upper carrier arm 26, which in operational position is roughly horizontal, is part of the right-angled separation lever 26 and juts out at a distance above the arm 25 of the fiber guide 24 and roughly parallel to it, and between the two individual fibers 11' and 12', thus preventing the fibers from the individual fibers 11', 12' from binding with one another above the arm 25.

Figure 2:
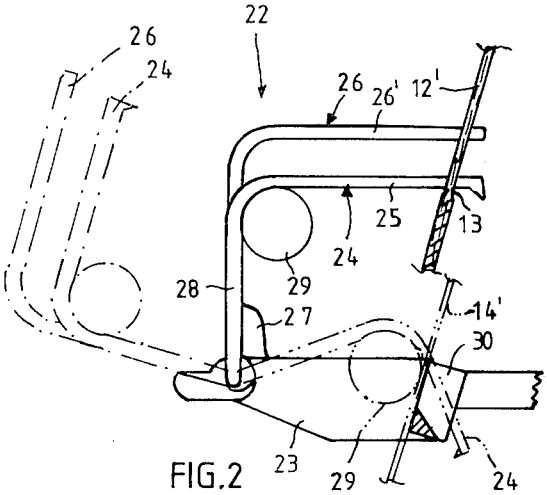
FIG. 2 shows a side view of the fiber break guard as in FIG. 1 but in enlarged size.
Figure 3:
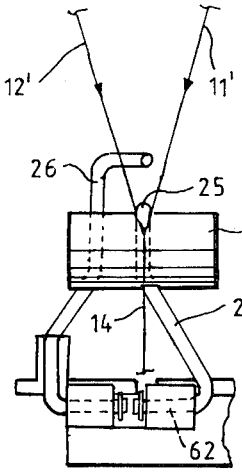
FIG. 3 is a rear view of the fiber break guard as in FIG. 2.

At the bend of the shank 28 of the fiber guide 24, directed upward in FIG. 2, a cylinder 29 running parallel to the rotational axis 62 of the fiber guide 24 is firmly attached on the inner side. In case of a fiber break for one of the two fibers 11', 12' this cylinder moves into the lower position indicated by the dotted lines and clamps the remaining fibers 14' between itself and the opposite piece 30 which runs parallel to the carrier 21 is and mounted on the beam 23. This takes place as a consequence of the weight of the fiber guide 24 and the swinging of the guide in a clockwise direction (FIG. 2). This cylinder 29 thus forms, together with its opposite piece 30, a clamping device.

In this dotted-line "clamping position" of the fiber guide 24 its arm 25 lies on a narrow rear slit 31 of the opposite piece 30. If a fiber break is to be eliminated, the operating person swings the fiber guide 24 and the separation lever 26 into the upper position indicated by the dotted lines in FIG. 2, and after repairing the break, swings the fiber guide 24 and the separation lever 26 back into the operational positions indicated in FIG. 2. If thereafter one of the two individual fibers 11' or 12' should break, the fiber guide swings in a clockwise direction due to its own weight as already described, until it is considerably below the union point 13 and further than the maximum fiber length of the fiber bands 11 and 12, which corresponds to a clampdown position in which it clamps the remaining fiber 14' between itself and its opposite piece 30. Then it is unimportant for the rapidly following fiber break whether the clamping force was so strong that the fiber is immovable, or whether the fiber is merely pinched somewhat between parts 29 and 30 and can still move in the direction of the spindle 15. In either case the pinching of the remaining fiber 14' between the cylinder 29 and the opposite piece 30 prevents any propagation of the twist to the remaining fiber 14', by means of the traveller 17 rotating about the ring 16, beyond the clamping device where the remaining fiber 14' is clamped down. In either case the break of the remaining fiber located between the delivery roller pair 10 and the clamping device occurs very rapidly.

The free arm 25 of the fiber guide 24 is, in this design example, somewhat angled downward (cf. FIG. 2) so that the union point 13 will not wander out over the free end of the arm 25 during operation.

Figure 5:
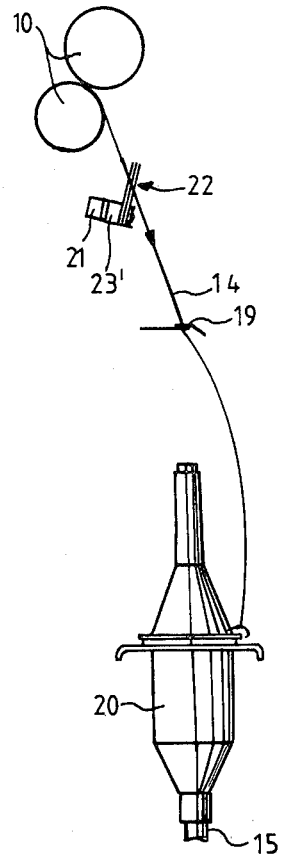
FIG. 5 shows a cross-sectional side view of a spinning location with a fiber break guard in accordance with a second design example of the invention.
Figure 6:
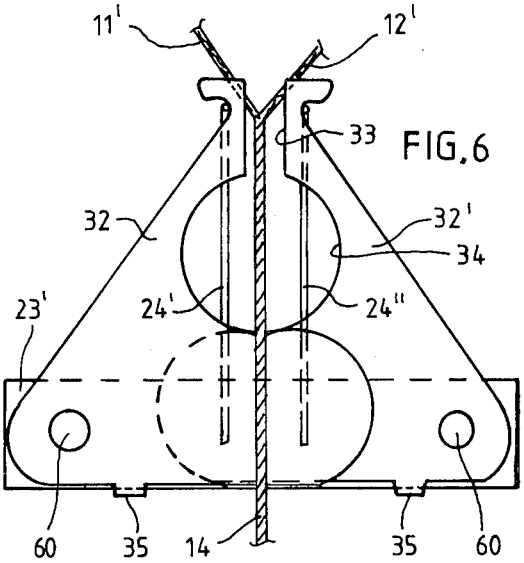
FIG. 6 is a front view of the fiber break guard as in FIG. 5, in enlarged size.
Figure 7:
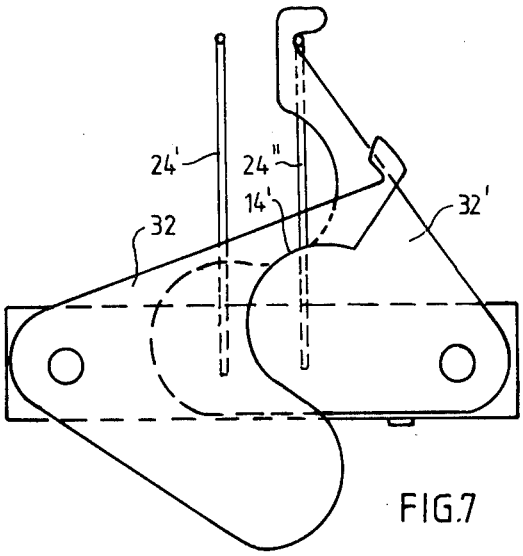
FIG. 7 is the fiber break guard as in FIG. 6, but in a position which clamps down on the remaining fibers.

In the design example according to FIGS. 5 through 7, a fiber break guard 22 is arranged on a carrier 21 which runs horizontally along the spinning frame. It has as a fiber guide two springs 24', 24' which are located in a holding piece 23' mounted on the carrier 21; these springs are essentially straight and made out of spring wire. On their free ends they are angled off at right angles.

On both ends of the holding piece 23' there are two overlapping, leaf-shaped clamping pieces 32, 32' which are pivotally-mounted on parallel axles with relatively low angles to the horizontal. These two clamping pieces 32, 32' have the same shape and in their operational position as in FIG. 6 mirror each other, thus forming a wide entry channel 33 for entry of the yarn 14. This entry channel 33 widens into a basically round bay 34. The yarn 14 moves through the middle of the bay at an angle between the springs 24' 24'' which bridge the bay and are open at the rear (FIG. 6) during normal operation. These springs 24',24'' limit the lateral motion of the yarn 14 parallel to the lengthwise direction of the carrier 21 which results from normal operation. The clamping pieces 32, 32' are adjacent to the rear of the holding piece 23' as in FIG. 6 and have flanges 35 which are angled away so that they cannot be swung further outward but rather swing downward as a result of their own weight via the springs 24', 24'' which are basically positioned to hold them straight as in FIG. 6. The force with which the downward-facing free ends of the springs 24', 24'', in their situation at the nose of the clamping pieces 32, 32', actually hold these pieces in an upright position, is very small. Thus, if one of the two individual fibers 11' or 12' breaks and the remaining fiber 14' thereby deviates to the sides, the remaining fiber 14' causes the spring 24' or 24'' to bend due to the friction between it and the nose of the related clamping piece 32 or 32', which in turn releases the appropriate clamping piece 32 or 32'. This clamping piece then immediately swings downward due to its own weight and brings the remaining fiber 14' with it, clamping it between itself and the other clamping piece 32 or 32'. If, for example, the right-hand individual fiber 12' breaks (cf. FIG. 6), the remaining fiber 14' first displaces itself to the left and presses the spring 24' to the left, away from the nose of the clamping piece 32. Thereby this clamping piece 32 swings downward into the position depicted in FIG. 7 and takes the remaining fiber 14' along with it and clamps it between itself and the other clamping piece 32' as in FIG. 7. This quickly leads to a fiber break of the remaining fiber 14', in which case the twist imparted on the fiber by the spindle can no longer be propagated beyond the two clamping pieces 32, 32'. Thus the remaining fiber area 14' between the delivery roller pair 10 and the clamping device quickly breaks.

Figure 8:
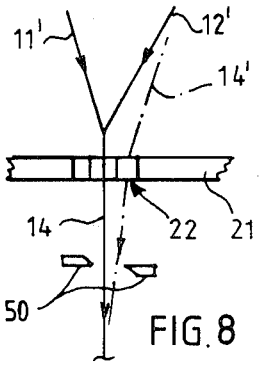
FIG. 8 is a partial front view of a spinning location with a fiber break guard in accordance with a third design example of the invention.
Figure 9:
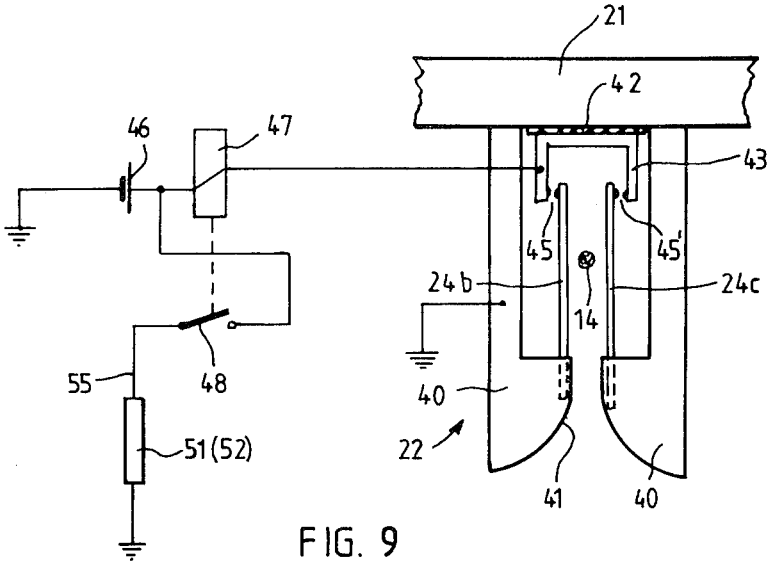
FIG. 9 is a top view of the fiber break guard as in FIG. 8, in enlarged view, whereby the electrical circuit for switching on the cutting device is schematically illustrated in part.

For the design variation in FIGS. 8 and 9, a fiber break guard is attached to a carrier 21. The guard has a fiber guide consisting of two straight springs **24*b*, 24*c*. These springs 24*b*, 24*c* are firmly suspended on stiff holding arms 40, which in turn are located on a carrier 21, vertically in relation to it and angled somewhat foreward. The springs 24*b*, 24*c* extend parallel to the holding arms 40 go between them, and then extend roughly horizontally to the rear. The spread-out free ends of the holding arms border within themselves a funnel-formed gap 41 which branches into the fiber guide gap formed by the two springs 24*b*, 24*c* and through which the yarn 14 moves with side play. When the fiber break is being repaired, the yarn 14** can easily be threaded into the fiber guide gap by the operator.

In addition, a contact fork 43 insulated from the carrier 21 by electrical insulation is mounted on that carrier, between which the free ends of the two springs **24*b*, 24*c* intrude, carrying electrical contacts which can be depressed to close an electrical circuit with the contact fork 43. Each spring 24*b* and 24*c* thus forms an electric circuit 45, 45' with the contact fork 43. The contact fork 43 is connected to a voltage source 46 and the two springs 24*b*, 24*c* are grounded via the holder arms 40. A relay 47 is located in the line from the voltage source 46 to the contact fork 43; it opens and closes a switch 48 which is normally open and is closed by excitement of the relay. This switch 48 serves to open and close an electrical circuit 55 into which the exciter coil 51 of an electromagnet (not illustrated further) is connected and further serves to activate a cutting device 50, located below the fiber break guard 22, so as to cut the individual fiber 14' when one of the fibers 11', 12' has broken. This is shown by the dotted lines in FIG. 8**. Since electrically activated cutting devices are basically known, they need no further explanation.

The relay 47 is preferably designed such that it only closes the switch 48 when the switch 45 or 45' which activates it is closed for a small minimum time without interruption. This is so because the springs **24*b* and 24*c* can be moved so as to close the switch 45 not only by the remaining fiber 14', but also by strong lateral deviations of the yarn 14, which can close the switch 45, 45' for a short period of time. On the other hand, the lateral deviation of the remaining fiber causes a longer closing of the relevant switch 45, 45' such that only a break in the fiber of 11', 12' leads to a closing of the switch 48 and thus to a cutting of the remaining fiber 14'**.

This fiber break guard as in FIGS. 8 and 9 also ensures that a quick and dependable breaking of the remaining fiber will take place whenever there is a break in one of the individual fibers 11', 12'.

The cutting device 50 can also be replaced by another separation device for separating the remaining fiber. Thus, hot wires 52 can be used instead for burning through the fiber. Instead of the exciter coil 51, they are placed in series with the voltage circuit 55, or parallel to one another. These hot wires 52 should be arranged along both sides of the yarn 14 path such that at least one hot wire comes in contact with the remaining fiber 14' which is designated by dotted lines in FIG. 8 after there has been a break in one of the two individual fibers 11', 12'. The remaining fiber 14' causes the unaffected spring **24*b* and 24*c* to bend and close the appropriate switch 45 or 45'. The hot wires 52 are switched on by the relay 47 of the switch 48 by means of this switch 45 or 45' and the remaining fibers are quickly burnt through, and thus the break of the remaining fibers 14'** is achieved.

Thereafter the spring **24*b* or 24*c* which was involved returns to its original position as illustrated in FIG. 9 upon opening of the switch 45 or 45', and switches the hot wires 52** off again.

Figure 10:
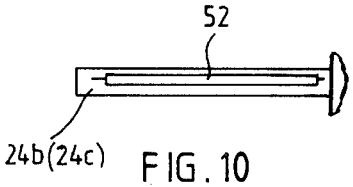
FIG. 10 is a variant of the spring of the fiber guide as in FIG. 9, with one of these springs being illustrated in side view, showing the use of the hot wire with the spring instead of the cutting device in FIG. 8.

The hot wires 52 can be arranged away from the springs **24*b*, 24*c*, but it is more advantageous and also simpler and safer to have them arranged along the lengthwise side of the springs 24*b*, 24*c* where they face the yarn 14, and to electrically insulate them, as is illustrated in FIG. 10. FIG. 10 shows such springs 24*b* and 24*c* in the corresponding side view, whereby the electrically isolated hot wire is designated as 52**.

It is also possible to have an electromagnetically activatable clamping device for clamping down the remaining fiber 15', rather than a cutting device 50. The clamping device would clamp down the remaining fiber 14' so that it breaks whenever there has been a closing of the switch 45 or 45'.

We claim:

1. In a spinning frame of the type having a plurality of spinning locations with each spinning location having means for drawing two fibers, bringing said fibers together at a union point and twisting said fibers together to form a yarn and fiber break guard means having fiber sensing means which, as a consequence of the breaking of one of the individual fibers, is displaced from its normal operational position by the lateral movement of the remaining fiber, the improvement comprising first and second fiber clamping means mounted on said frame with at least said first clamping means being pivotally mounted on said frame and being in operative contact with said fiber sensing means so that upon lateral movement of said remaining fiber said fiber sensing means will be displaced to cause said first clamping means to pivot and clamp said remaining fiber against said second clamping means.

2. In a spinning frame as set forth in claim 1 wherein said first clamping means and said fiber sensing means are connected together with said fiber sensing means adapted to press against said fibers at said union point and said second clamping means is comprised of a stationary clamping member located below said first clamping means so that on breaking of one of said fibers said first clamping means will pivot downwardly under the force of gravity to clamp the remaining fiber against said stationary clamping member.

3. In a spinning frame as set forth in claim 1 wherein said first and second fiber clamping means are each pivotally mounted on said frame with each clamping means having a clamping surface spaced from the clamping surface on the other clamping means to define a passage for said yarn and further comprising first and second spring means mounted on said frame on opposite sides of said yarn in supporting contact with said first and second clamping means respectively whereby upon breaking of one of said fibers the remaining fiber will contact one of said spring means to move said one of said spring means out of supporting engagement with the respective clamping means so that said respective clamping means will pivot downwardly under the force of gravity to clamp the remaining fiber between the clamping surfaces on said first and second fiber clamping means.

4. In a spinning frame of the type having a plurality of spinning locations with each spinning location having means for drawing two fibers, bringing said fibers together at a union point and twisting said fibers together to form a yarn and fiber break guard means having fiber sensing means which, as a consequence of the breaking of one of the individual fibers, is displaced from its normal operational position by the lateral movement of the remaining fiber, the improvement comprising a pair of spring means mounted on said frame on opposite sides of said yarn to define said fiber sensing means, a pair of electrical contacts disposed in spaced relation to the free end of the spring means respectively, fiber severing means and circuit means including said spring means, said contact means, and said fiber severing means so that upon breaking of one of said individual fibers one of said spring means will be displaced by the lateral movement of the remaining fiber to engage a respective contact means to energize said fiber severing means to sever said remaining fiber.

5. In a spinning frame as set forth in claim 4 wherein said fiber severing means is comprised of solenoid operated cutting means.

6. In a spinning frame as set forth in claim 4 wherein said fiber severing means is comprised of a pair of hot wires mounted on said spring means respectively for engagement with said remaining fiber upon lateral movement of said remaining fiber.

* * * * *